US007274344B2

(12) United States Patent
Lacoste et al.

(10) Patent No.: US 7,274,344 B2
(45) Date of Patent: Sep. 25, 2007

(54) METHOD FOR DRIVING A PLASMA DISPLAY BY MATRIX TRIGGERING OF THE SUSTAIN DISCHARGES

(75) Inventors: Ana Lacoste, St Martin le Vinoux (FR); Dominique Gagnot, Charavines (FR); Laurent Tessier, Fontaine (FR)

(73) Assignee: Thomson Plasma, Boulogne-Billancourt (FR)

( * ) Notice: Subject to any disclaimer, the term of this patent is extended or adjusted under 35 U.S.C. 154(b) by 671 days.

(21) Appl. No.: 10/846,190

(22) Filed: May 14, 2004

(65) Prior Publication Data

US 2004/0252082 A1 Dec. 16, 2004

(30) Foreign Application Priority Data

May 16, 2003 (EP) ..... 0305929

(51) Int. Cl.
*G09G 3/28* (2006.01)

(52) U.S. Cl. ..... 345/68; 345/60; 345/67; 345/204; 345/690; 315/169.1; 315/169.3; 315/169.4

(58) Field of Classification Search ..... 345/60, 345/67, 68, 204, 690; 315/169.1, 169.3, 315/169.4
See application file for complete search history.

(56) References Cited

U.S. PATENT DOCUMENTS 5,962,983 A * 10/1999 Anderson et al. ..... 315/169.4
6,184,848 B1 * 2/2001 Weber ..... 345/60
6,376,995 B1 * 4/2002 Kato et al. ..... 315/169.3
2002/0008680 A1 1/2002 Hashimoto et al. ..... 345/63
2002/0030645 A1 * 3/2002 Lee et al. ..... 345/68

FOREIGN PATENT DOCUMENTS

EP 1339038 A1 8/2003

OTHER PUBLICATIONS

Patent Abstract of Japan; Pub. No. 10333635; Pub. Date Dec. 18, 1998; Applicant NEC Corp; Title: Driving Method for Plasma Display Panel.
XP-001171716; Highly Luminous-Efficient AC-PDP with DeITA Cell Structure Using New Sustain Waveforms; Y. Seo, T. Kosaka, H. Inoue, N. Itokawa, and Y. Hashimoto; SID 03 DIGEST; Fujitsu Laboratories Ltd., Akashi, Japan.

* cited by examiner

*Primary Examiner*—Bipin Shalwala
*Assistant Examiner*—Vincent E. Kovalick
(74) *Attorney, Agent, or Firm*—Joseph J. Laks; Harvey D. Fried; Patricia Verlangieri

(57) ABSTRACT

A method for driving a plasma display having discharge regions each crossed by a pair of sustain electrodes ($Y_S$, $Y_{AS}$) and at least one trigger electrode ($X_A$) is disclosed. The method includes a succession of image frames or subframes which each have a discharge region sustain phase including the application of voltage pulses $V_S$ between the electrodes of each pair of sustain electrodes serving these regions, and the application of a trigger pulse $V_M$, of duration $\tau_M$ less than 1 μS, between the trigger electrode ($X_A$) and one and/or the other of the electrodes of each pair serving these regions. The intensity and luminous efficiency of plasma displays can thus be significantly improved.

10 Claims, 8 Drawing Sheets

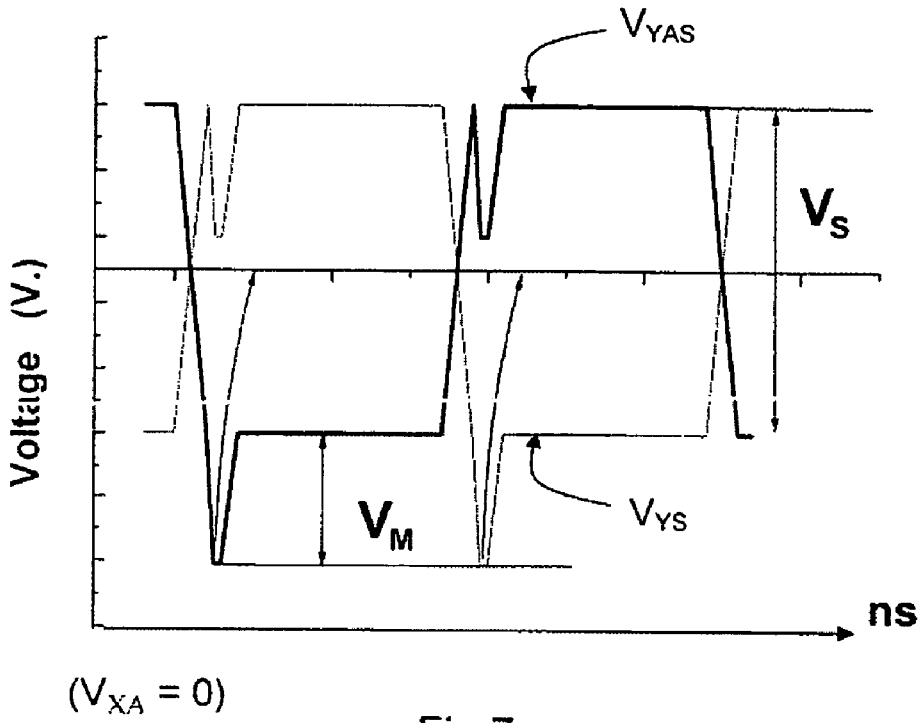
Fig.7
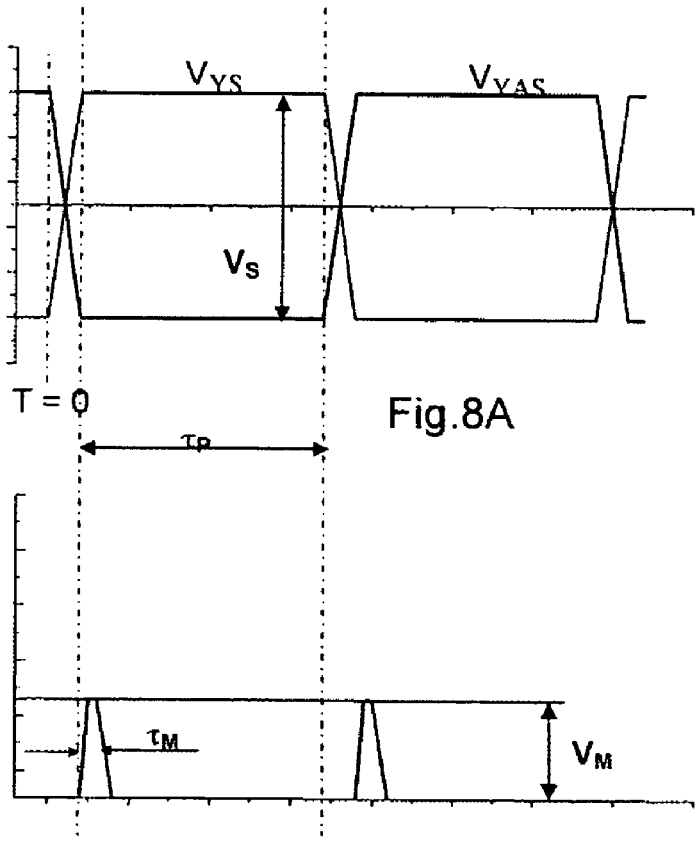
Fig.8A
Fig.8B

METHOD FOR DRIVING A PLASMA DISPLAY BY MATRIX TRIGGERING OF THE SUSTAIN DISCHARGES

BACKGROUND OF THE INVENTION

The invention relates to a method for driving a plasma display for displaying images.

Document U.S. Pat. No. 2002/0030645 describes a method for displaying images applied to a conventional AC plasma storage display having two plane panels, one front and one rear, enclosing between them a space filled with discharge gas which is partitioned into discharge regions, notably using barrier ribs placed between the panels. The front panel comprises two arrays of coplanar sustain electrodes which are covered with a dielectric layer providing the storage effect. Each electrode of one of the arrays forms a pair with an electrode of the other array. The rear panel comprises an array of address electrodes which are oriented perpendicularly to the sustain electrodes. Thus, in this conventional structure each discharge region comprises three electrodes.

When driving according to the method described in the document U.S. Pat. No. 2002/0030645, within each cell during the sustain phase, matrix discharges, which are formed within the gas-filled space between the panels, trigger longer, coplanar discharges which are formed between the electrodes mounted on the same panel.

Other documents describe analogous driving methods where coplanar sustain discharges are triggered by matrix discharges. Documents U.S. Pat. No. 5,962,983 or U.S. Pat. No. 6,376,995 may be cited for example. The document entitled "Highly luminous-efficient AC-PDP with DelTA Cell structure using new sustain waveform" by Y. Seo et al. (FUJITSU Lab.), published on 22 May 2003 during the International Symposium of the SID (SID Vol. 34/1, pages 137-139, XP001171716), describes a driving method in which the trigger voltage pulses are very short, of the order of 150 ns.

Document U.S. Pat. No. 6,184,848 describes an analogous method of driving applied to a display comprising three coplanar electrode arrays mounted on the same panel, the other panel comprising, as previously, an array of address electrodes. Each cell therefore here comprises four electrodes, of which three are coplanar. The first coplanar electrode only for the trigger, the second for both the trigger and the sustain itself, the third only for the sustain. Within each cell, a trigger, or "narrow-gap", region between the first two coplanar electrodes which are relatively close together, and a discharge expansion, or "wide-gap", region between the last two coplanar electrodes, which are further apart, are therefore to be distinguished from each other.

Such a driving method applied to one or the other of these displays allows discharges to be triggered between the sustain electrodes of each pair, even when the gap separating them is wide, without having to increase the voltage of the sustain pulses. Thanks especially to greatly lengthened discharges being obtained between these electrodes, such a driving method allows the luminous efficiency of plasma displays with coplanar sustain electrodes to be significantly improved.

Indeed, in a plasma discharge, the energy efficiency of a positive or pseudo-positive column is much higher than that of a negative glow, which is why there is an interest in designing plasma display structures and in using methods for driving these displays that allow stable operation in this pseudo-positive column regime. However, in a conventional display structure using three electrodes and with the driving method that has just been described, obtaining a positive column plasma by simply increasing the gap between the coplanar electrodes does not lead to a very significant increase in the luminous efficiency. As is explained hereinafter, this difficulty in implementing wide-gap discharges, with a luminous efficiency much higher than that of narrow-gap discharges, can be explained by the close correlation between the discharge formation mechanism and the electrical signals applied to these electrodes.

SUMMARY OF THE INVENTION

An essential aim of the invention is to optimally improve the luminous efficiency of coplanar discharges in plasma displays, especially when they are driven by triggering these discharges using matrix discharges.

For this purpose, an object of the invention is a method for driving a plasma display for displaying images, in which sustain electrode arrays and at least one trigger electrode array, discharge regions which are each crossed by a pair of sustain electrodes and at least one trigger electrode. The method includes a succession of image frames or subframes which each comprise a discharge region sustain phase which itself comprises the application of approximately constant sustain voltage pulses $V_S$ between the electrodes of each pair serving these regions, and the application of a trigger voltage pulse $V_M$ between the trigger electrode and one and/or the other of the electrodes of each pair serving these regions, the voltage $V_M$ being designed to trigger a plasma discharge between the electrodes of the said pair, and the duration $\tau_M$ of each trigger pulse being less than 1 μS.

In practice, each sustain pulse comprises a rising edge, an approximately constant voltage plateau $V_S$ of duration $\tau_P$ and a falling edge. Preferably, the duration $\tau_M$ of the trigger pulses is less than the duration $\tau_P$ of the sustain pulses.

The trigger pulse can be obtained either by applying it directly to the trigger electrodes or, keeping the trigger electrode potential constant, by superimposing complementary pulses onto the sustain pulses, provided to each electrode of the sustain pairs.

According to a first embodiment of the invention, the sustain voltage $V_S$ is greater than or equal to the value $V_{S\text{-}min}$ from and beyond which sustain discharges can be obtained in the display without trigger pulses during the sustain phases. If the duration of the voltage plateau $V_S$ of the sustain pulses is denoted $\tau_P$ and the time interval between the beginning of a trigger pulse and the moment when the discharge current in the trigger electrode ($X_A$) becomes zero is denoted $\tau_C$, then: 50 ns$\leqq\tau_C\leqq$150 ns, and preferably, if $\tau_P\geqq$2 μs, 100 ns$\leqq\tau_M\leqq$1 μs, if 1.2 μs$\leqq\tau_P\leqq$2 μs, 100 ns$\leqq\tau_M\leqq\tau_P$−1 μs, if $\tau_P$<1.2 μs, 100 ns$\leqq\tau_M\leqq$200 ns.

Thanks to the invention, the light emission performance of the display and the efficiency of the discharges are significantly improved.

The moment when the current in the trigger electrode becomes zero, corresponds to the beginning of the discharge extension between the sustain electrodes of a pair and to the end of the connecting role played by the trigger electrode.

By applying the trigger pulses in this fashion, the sustain discharges are triggered prematurely and their intensity and efficiency are significantly improved. Clearly, the voltage $V_M$ should be designed to achieve this premature triggering and to avoid a "spontaneous" triggering of the discharges identical to that which would be obtained in the absence of trigger pulses.

According to a second embodiment of the invention, the sustain voltage $V_S$ is lower than the value $V_{S-min}$ from and beyond which sustain discharges can be obtained in the display without trigger pulses during the sustain phases and each trigger pulse is now applied during a sustain pulse. Thanks to the invention, the light emission performance of the display and the efficiency of the discharges are significantly improved.

In this case, only the application of trigger pulses is able to cause the initiation of the sustain discharges within the discharge regions. The sustain pulses are insufficient in themselves to initiate discharges between the electrodes of the pairs and the trigger pulses are designed to trigger these discharges in combination with the sustain pulses.

According to the invention, each trigger pulse thus begins after the end of the rising edge of a sustain pulse and finishes before the beginning of the falling edge of this sustain pulse. In this way, stable discharges having a good luminous efficiency are obtained.

Preferably, if the duration of the sustain pulses is denoted $\tau_P$ and the time interval between the beginning of the plateau of a sustain pulse and the beginning of a corresponding trigger pulse is denoted $\tau_R$, then:

if $\tau_P \geqq 2$ μs, 100 ns$\leqq\tau_M\leqq$1 μs and $\tau_R\leqq\tau_P-1$ μS$-\tau_M$, if 1.2 μs$\leqq$, $\tau_P\leqq 2$ μs, 100 ns$\leqq\tau_M\leqq\tau_P-1$ μs and $\tau_R\leqq\tau_{\mu S-\tau M}$, if $\tau_P<1.2$ μs, 100 ns$\leqq\tau_M<200$ ns and $\tau_R\leqq$100 ns.

By 'trigger pulse corresponding to a sustain pulse' is meant the pulse which triggers a sustain discharge occurs during this sustain pulse.

Preferably, if $\tau_P<1.2$ μs, $\tau_R$ is close to zero.

By applying the trigger pulses in this fashion, the intensity and the efficiency of the sustain discharges are significantly improved.

Preferably, if the time interval between the moment $T_M$ of the beginning of a trigger pulse and the moment $T_{I-max}$ of the peak light emission of the sustain discharge triggered by this trigger pulse is denoted $\tau_{I-max}$, then $\tau_M<\tau_{I-max}$.

By thus terminating the trigger pulses before the peak current or light intensity of the discharges, the efficiency and the intensity of these discharges are again improved.

Whether it be according to the first or second embodiment, preferably there is no voltage plateau between two consecutive sustain pulses during a sustain phase.

By 'voltage plateau' is meant an interval of time of a significant duration, typically greater than 10 ns, during which the voltage between the electrodes of the various pairs is approximately constant, notably zero. By avoiding a zero-level voltage plateau between the sustain pulses, the risks of self-erasing the discharge regions are limited, a satisfactory storage effect is preserved and the stability of the discharges within the display is improved.

Each frame or subframe also generally comprises, before each sustain phase, an address phase for selectively activating display discharge regions and the trigger pulses are designed to trigger discharges in combination with the sustain pulses only in the preactivated discharge regions.

Each frame or subframe also generally comprises, before each address phase, a discharge region reset phase. This reset phase conventionally comprises a charge priming and a charge erase operation.

Another object of the invention is a device for displaying images having a plasma display including sustain electrode arrays and at least one trigger electrode array, discharge regions which are each crossed by a pair of sustain electrodes and at least one trigger electrode. The display device also includes a means for implementing the driving method according to the invention.

The plasma display thus preferably has one or more of the following features. The trigger electrodes are also used for the address phases. The distance separating the sustain electrodes of a same pair within each region is greater than the distance separating the trigger electrode from one and/or the other electrodes of this pair within this same region. Such a configuration is capable of generating so-called 'wide-gap' sustain discharges. The distance separating the sustain electrodes of each pair is, preferably, greater than or equal to 500 μm. The width of each sustain electrode is less than or equal to 150 μm.

In spite of the narrow width of the sustain electrodes, extended positive-column plasma discharges providing a high luminous efficiency are still obtained thanks to the triggering of the sustain discharges by the trigger pulses according to the invention. This narrow width advantageously allows these electrodes to be made of an opaque conducting material, for example of aluminium, without a significant loss of light intensity. Such opaque materials are less costly than the transparent conducting materials, such as ITO, generally employed for these electrodes. The discharge regions are partitioned by barrier ribs disposed such that any two adjacent trigger electrodes from the trigger array are separated by a barrier rib.

BRIEF DESCRIPTION OF THE DRAWINGS

The invention will be better understood upon reading the following description, presented as a non-limiting example, and with reference to the appended figures in which:

FIG. 7 shows a variant from the timing diagrams in FIG. 3 relating to the sustain phase, for obtaining the trigger pulses;

FIG. 8A describes an example of sustain signals without intermediate voltage plateaux according to a preferred embodiment of the invention;

FIG. 8B shows the corresponding trigger signals;

The figures showing timing diagrams do not take any value scales into account in order to show certain details more clearly that would not be apparent if the proportions had been respected.

DESCRIPTION OF THE PREFERRED EMBODIMENTS

Figure 1:
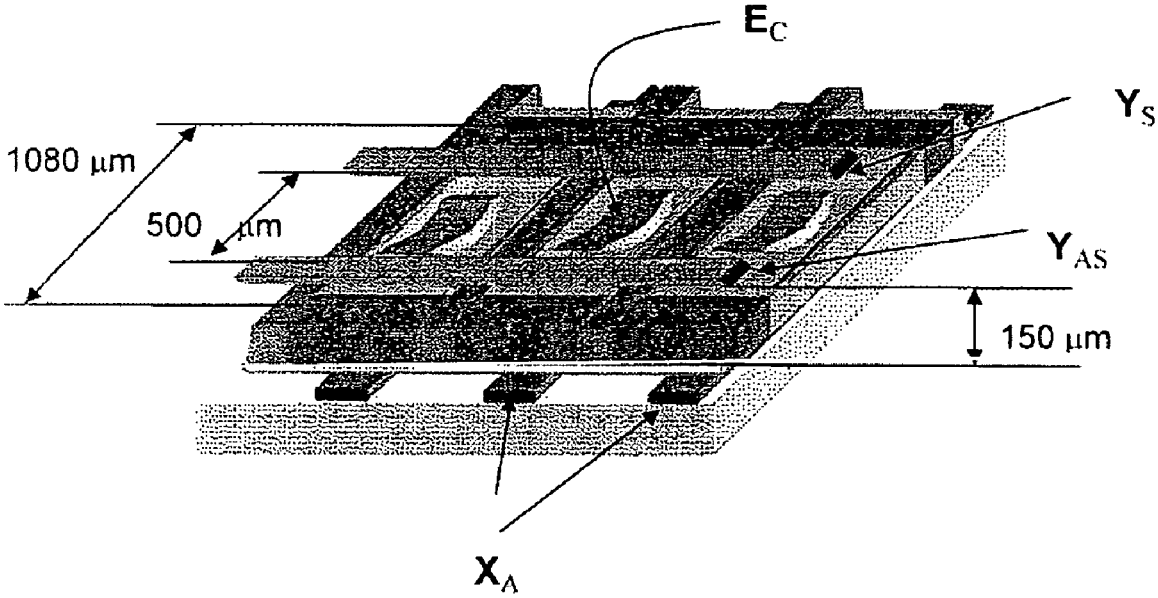
FIGS. 1 and 2 illustrate discharge regions in a plasma display to which the invention applies.
Figure 2:
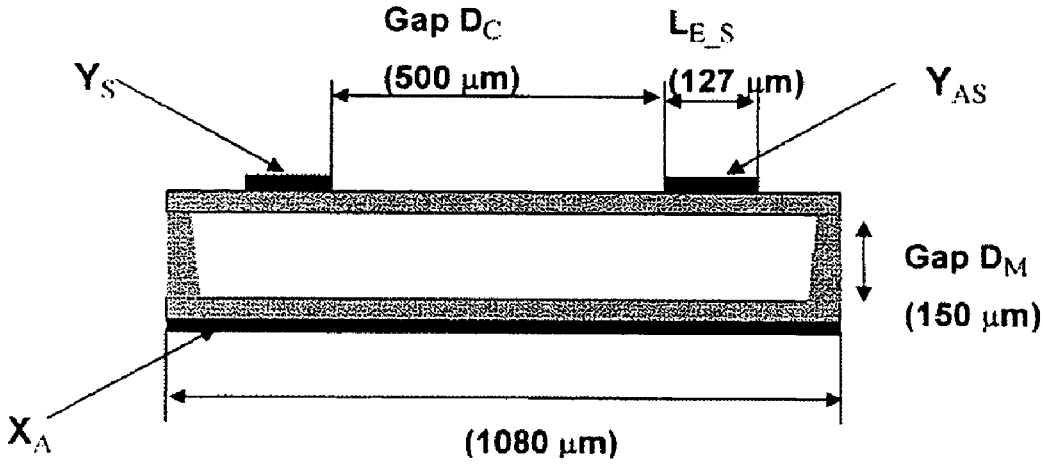

With reference to FIGS. 1 and 2, the plasma display, to which the driving method according to the invention will be applied, comprises two plane panels, one front and one rear, enclosing a space between them filled with discharge gas, here of 150 μm thickness. The front panel has two coplanar sustain electrode arrays which are coated with a dielectric layer (not shown). Each electrode $Y_S$ of one of the arrays forms a pair with an electrode $Y_{AS}$ of the other array. The rear panel has an array of address electrodes $X_A$ which are oriented perpendicularly to the sustain electrodes. Between the panels is an array of barrier ribs partitioning the space between the panels into discharge regions. There is a barrier rib between each pair of sustain electrodes. There is also a barrier rib between each address electrode. Each discharge cell or region of the display is thus bounded by the panels and by the barrier ribs.

According to one possible variant of plasma display, there are no barrier ribs between the sustain electrode pairs.

The distance separating the coplanar electrodes of a same pair, or gap $D_C$, is greater than the distance separating these electrodes from the address electrode at their crossing point. Thus, here the coplanar gap $D_C$ is 500 μm whereas the discharge gas thickness or matrix gap $D_M$ is 150 μm.

Here, the width of each coplanar sustain electrode $L_{E_S}$ is only around 127 μm, whereas it is generally much larger in conventional coplanar displays without matrix triggering. In these conventional displays, the reason for a greater width is to accommodate a larger region for expansion of the discharges.

The rear panel of the display and the sides of the barrier ribs are coated with phosphors which, under excitation by the ultraviolet radiation from the discharges, emit the various primary colours of the images to be displayed. FIG. 1 shows three cells of different colours, red, green and blue, which form one pixel of the display.

Here, the distance between two adjacent rows of cells or two pairs of electrodes is 1080 μm.

All the numerical values are given above by way of examples and should not be seen as limiting the scope of the invention.

As will be seen hereinafter, one of the electrodes $Y_{AS}$ of each pair is also used as address electrode.

Figure 3:
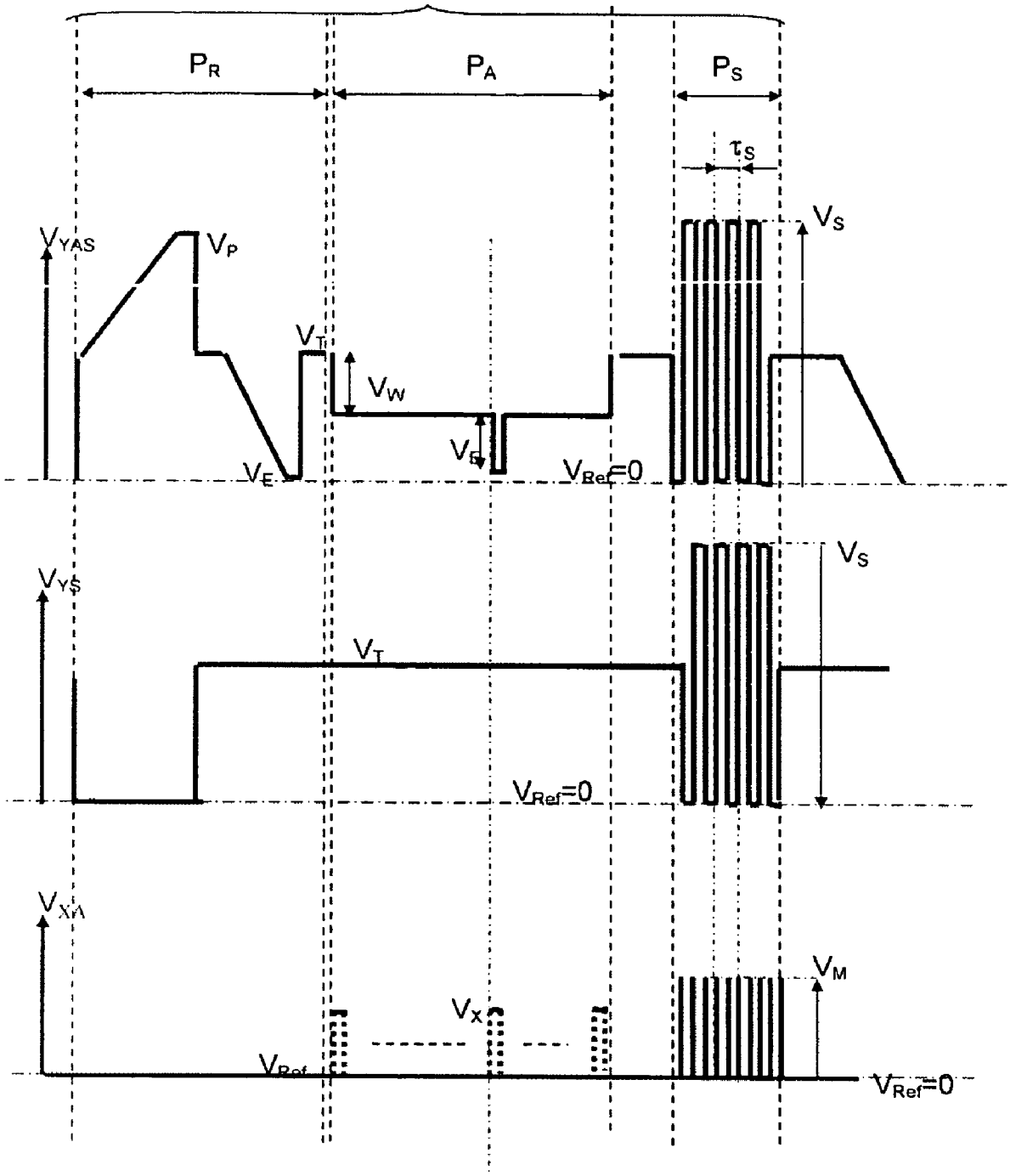
FIG. 3 illustrates timing diagrams of voltage signals applied to the electrodes of the display in one embodiment of the invention.

The production of an image on the plasma display in operation is effected in a conventional manner by a succession of scans, or subscans, of the discharge regions to be activated or not. With reference to FIG. 3, each scan or subscan comprises the following successive steps. First a discharge region reset step $P_R$. Here the discharge region reset step includes a charge-equalization operation, known as "priming", and a charge-erase operation. These operations are conventionally achieved by applying voltage signals in the form of a linear ramp.

Second, a selective addressing step $P_A$, whose purpose is to deposit electric charges on the portion of dielectric layer in the discharge regions to be activated, by applying at least one voltage pulse between the address electrodes $Y_{AS}$, $X_A$ crossing each other in these regions. This charge deposition corresponds to the activation of a discharge region.

Finally, a non-selective sustain step $P_S$ during which a succession of alternating voltage pulses $V_S$ are applied between the coplanar electrodes $Y_S$, $Y_{AS}$ of the sustain pairs and a succession of trigger pulses $V_M$ are applied between the electrodes $Y_{AS}$ of the front panel and the address electrodes $X_A$ of the rear panel so as to cause a succession of luminous discharges $E_C$ only in the discharge regions which are situated between these coplanar electrodes and which have been pre-activated.

As will be seen hereinafter, it is the address electrodes $X_A$ which are used to trigger the sustain discharges during the non-selective sustain step $P_S$. These address electrodes are therefore also trigger electrodes. According to a plasma display variant, a specific array of trigger electrodes, distinct from the address array, can be used for the triggering, as in the aforementioned document U.S. Pat. No. 6,184,848.

FIG. 3 shows three voltage pulse timing diagrams in which voltage signals are: applied to the sustain and address electrodes $Y_{AS}$; applied to the solely sustain electrodes $Y_S$; and applied to the address electrodes $X_A$ which cross the sustain and address electrodes $Y_{AS}$ within each cell. These timing diagrams represent a succession of the previously-described phases belonging to a same scan or subscan cycle of the plasma display.

In order to describe the operation of the coplanar sustain discharge in this so-called 'wide-gap' structure by way of an introduction to the invention, a single half-period of a sustain signal $\tau_S/2$ applied to a discharge region of the display will be considered. This half-period only comprises a single sustain pulse. During this half-period: the electrode $Y_{AS}$ is considered as cathode, the potential $V_{YAS}$ applied to this electrode is constant and zero, the current drawn by this electrode $I_{YAS}$ is therefore negative or zero; the electrode $Y_S$ is considered as anode, the potential $V_{YS}$ applied to this electrode reaches the value $V_S$ during the duration $\tau_P$ of the sustain pulse plateau and the current drawn by this electrode $I_{YS}$ is therefore positive or zero; the address electrode $X_A$ is considered as anode with respect to the electrode $Y_{AS}$, the potential $V_{XA}$ applied to this electrode reaches the value $V_M < V_S$ during the duration $\tau_M$ of the trigger pulse plateau and is zero outside of this period. The current drawn by the address electrode is denoted $I_{XA}$.

The coplanar electrodes $Y_S$, $Y_{AS}$, or rows, are supplied by a sustain pulse generator, or by reset generators, or by address bias generators, via, at least for one of the arrays, row (or line) drivers which allow each sustain electrode of this array to be connected or not to one or the other of these generators.

The address electrodes $X_A$, or columns, are supplied by an address pulse $V_X$ generator, or by a trigger pulse $V_M$ generator, via column drivers which allow each address electrode to be connected or not to one or the other of these generators.

Figure 4A:
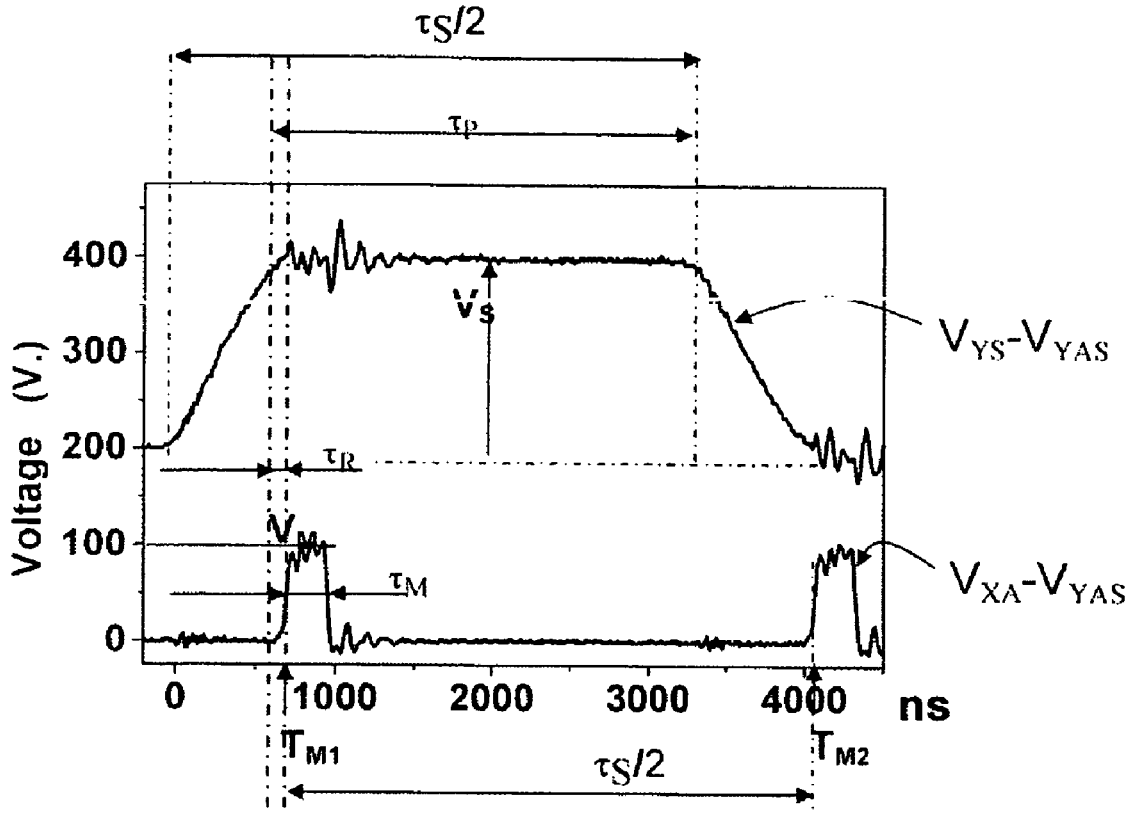
FIG. 4A shows, according to one embodiment of the invention, a sustain voltage pulse $V_S$ applied between the coplanar electrodes of a discharge region and a trigger pulse applied between one of these electrodes and the address electrode crossing this region.
Figure 4B:
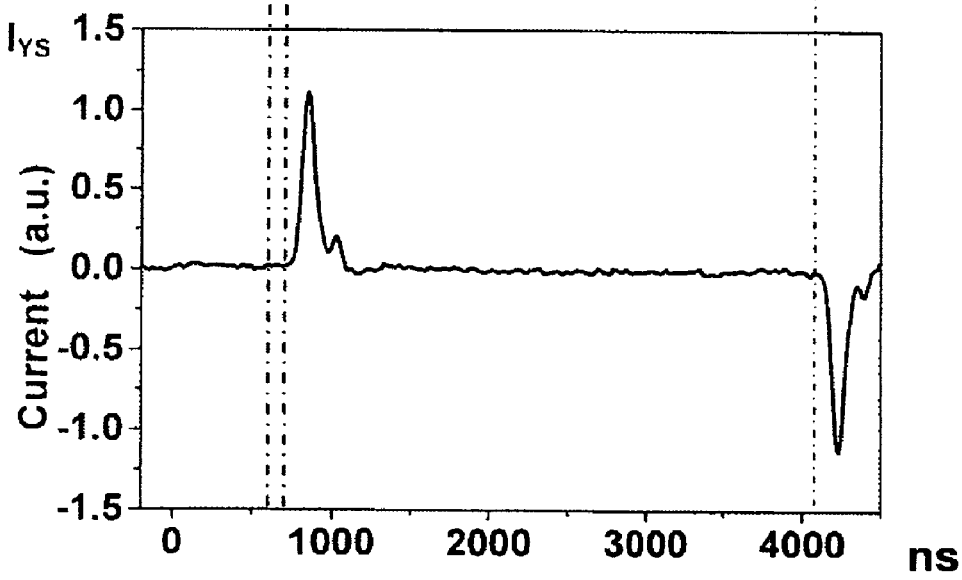
FIG. 4B shows the discharge current flowing between the coplanar electrodes in arbitrary units (a. u.)

Taking $V_S$=200 V and $V_M$=100 V, as shown in FIG. 4A, coplanar discharges whose current is shown in FIG. 4B (in arbitrary units) are obtained. The voltage $V_S$ is chosen to be lower than the minimum sustain voltage $V_{S\text{-}min}$, which would allow coplanar discharges to be obtained with $V_M$=0 V. Thus, if the case where $V_S$=200 V and $V_M$=0 V was taken, no coplanar discharges would be obtained.

Here, the plateau duration $\tau_P$ of a sustain pulse is around 2500 ns and the plateau duration τM of a trigger pulse is around 600 ns in the example shown.

Each sustain pulse comprises a rising edge starting from a reference voltage level which here is zero, a plateau at a constant voltage level $V_S$ and a falling edge returning to the reference voltage level. According to the example shown, the trigger pulse starts almost immediately after the end of the rising edge: the time delay between the end of the sustain pulse rising edge and the beginning of the trigger pulse is denoted $\tau_R$.

FIG. 4B illustrates the current $I_{YS}$ in the coplanar discharges obtained when applying the signals in FIG. 4A to the electrodes. This current is positive for the first discharge which is triggered at time $T_{M1}$ and during which the electrode $Y_S$ plays the role of anode. This current is negative for the second discharge which is triggered at the time $T_{M2}$ and during which the electrode $Y_S$ plays the role of cathode.

Figure 5A:
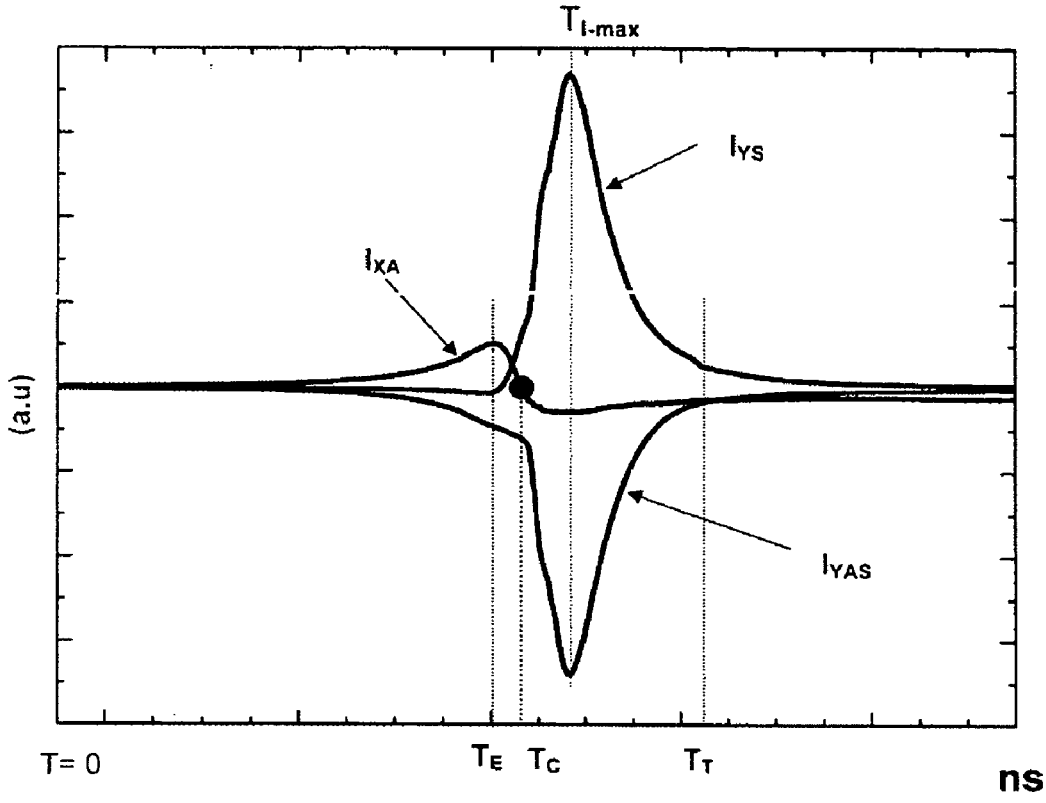
FIG. 5A shows the electric current drawn by the various electrodes in a discharge region starting from the beginning of a trigger pulse and during a sustain pulse.

FIG. 5A shows the evolution of the current as a function of time for the three electrodes in the cell, during and immediately following the application of the trigger pulse. In this figure, the first current peak, $I_{YS}$ of FIG. 4B, can again be seen located at the time $T_{I_max}$. The discharge corresponding to this peak therefore starts between the panels, in other words in the matrix, between the electrodes $Y_{AS}$ and $X_A$ which return to the same potential (zero) after the end of the trigger pulse. In this step, as illustrated in FIG. 5, $I_{XA}=-I_{YAS}$. Subsequently, the discharge develops and spreads out over the rear surface towards the centre of the cell until its connection with the anode, $Y_S$. This discharge, which is at first in the matrix, then coplanar, is divided over time into three stages: initiation of the matrix discharge, connection of this discharge with the coplanar anode and development of the coplanar discharge. This type of discharge corresponds to the transfer of electric charges between the areas of dielectric layer covering the various electrodes and ends up with a new charge equilibrium starting from which a new discharge can be triggered following the same stages, the succession of these discharges forming the non-selective sustain step $P_S$.

Taking the time origin T=0 as the beginning of the transient regime or beginning of the rising edge of the sustain signal applied between the coplanar electrodes, the three discharge stages and the new equilibrium obtained will now be presented in detail:

1. The time interval $0<T<T_E$ corresponds to the initiation phase of the matrix discharge. During this phase, there is an increase in the current on the electrodes $Y_{AS}$, $X_A$, disposed opposite each other on either side of the space between the panels, up to a peak current $I_{XA}$ on the electrode $X_A$ at time $T_E$.
2. The time interval $T_E \leqq T<T_C$, where $T_C$ is the moment when $I_{XA}$ becomes zero, corresponds to the extension of this discharge towards the centre of the cell until its connection with the anode $Y_S$.

During these first two intervals, 1 and 2, covering the initiation of the matrix discharge and then the connection of this discharge with the coplanar anode $Y_S$, the total (negative) charge transferred onto the address electrode $X_A$ is $$Q_M = \int_0^{T_C} I_{(XA)}\, dt.$$

From the curves in FIG. 5A, it can be deduced that, during these two intervals of time, a charge transfer $Q_C$ starts to take place between the coplanar electrodes $Y_{AS}$, $Y_S$ (since $I_{YS}\neq 0$), via the electrode $X_A$ which plays a connecting role.

3. At time $T=T_C$ the coplanar discharge is established. At this moment, the electrode $X_A$ no longer plays a connecting role and the current on this electrode passes through zero ($I_{XA}=0$). After this time ($T>T_C$), the coplanar discharge develops by transferring charges directly between the electrodes $Y_{AS}$ and $Y_S$ (cathode-anode). The electrode $X_A$ then just plays the role of intermediate cathode which equates to a transfer of positive (ionic) charge.

The total electric charge transferred between the coplanar electrodes during the entire discharge is $$Q_C = \int_0^{T_T} I_{(YS)}\, dt,$$

where $T_T$ represents the total discharge time. In other words the time interval between the beginning of the trigger pulse and the end of the coplanar discharge where all the electrode currents are zero or almost zero. At the time of the end of the discharge, $I_{XA}$, $I_{YS}$ and $I_{YAS}$ are therefore zero or almost zero, in other words, in practice below 1 μA, or, for $I_{YS}$ and $I_{YAS}$, below 1% of the maximum value of $I_{YS}$ and $I_{YAS}$ during the discharge. It is recalled that $T_{I\text{-}max}$ is the moment of peak current intensity or peak emission for the coplanar discharge (see FIG. 5).

Figure 5B:
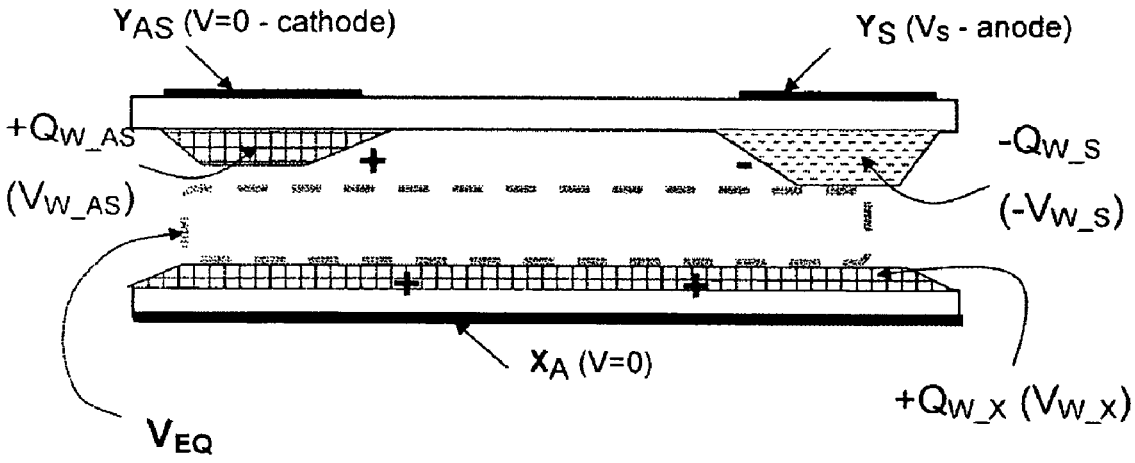
FIG. 5B shows the state of the electric charges on the dielectric layer regions covering the various electrodes in the discharge region of FIG. 5A, after the end of the trigger pulse but during the same sustain pulse.

4. The new charge equilibrium obtained after the end of the discharge in the cell under consideration and after the end of the trigger pulse is shown in FIG. 5B:
   the potentials applied to the electrodes are the following: $V_{YAS}=V_{XA}=0$, $V_{YS}=V_S$;
   the surface potentials of the dielectric layers inside the cell are the following:
   - $V_{W_AS}$ on the electrode $Y_{AS}$, corresponding to a positive charge $Q_{W_AS}$;
   - $-V_{W_S}$ on the electrode $Y_S$, corresponding to a negative charge $-Q_{W_S}$;
   - $V_{W_X}$ on the electrode $X_A$, corresponding to a positive charge $Q_{W_X}$;

Since the discharge is over and all the currents are zero or virtually zero, the voltage in the cell gas is zero: $V_{\text{-}gas}=0$.

On the left side of the cell, where $Y_{AS}$ and $X_A$ cross each other, therefore:

$$(0+V_{W_AS})-(0+V_{W_X})=0$$

On the right side of the cell, where $Y_S$ and $X_A$ cross each other, therefore:

$$(V_S-V_{W_S})-(0+V_{W_X})=0$$

which is equivalent to an equipotential curve drawn as the dashed line in FIG. 5B and corresponding to the potential: $V_{EQ}$.

Therefore: $V_{EQ.}=0+V_{W_AS}$; $V_{EQ.}=V_S-V_{W_S}$; $V_{EQ.}=0+V_{W_X}$, which equations are satisfied for: $V_{W_AS}=V_{W_X}=V_{W_S}=V_S/2$. Therefore: $V_{EQ.}=V_S/2$.

A complete demonstration of this solution is within the competence of those skilled in the art. It would take into account the capacitances of the dielectric layers of each panel, the capacitance of the gas and, notably, the charge conservation equation for the transfers during the discharge: $Q_{W_AS}+Q_{W_x}-Q_{W_S}=0$.

In addition, $\tau_Q$ is defined as the period necessary to reach charge equilibrium, which period is measured starting from the beginning of the trigger pulse. It will be recalled that this equilibrium is defined as when the values of the currents $I_{YS}$ and $I_{YAS}$ in the coplanar electrodes fall to levels below 1% of the peak values obtained during the discharge. This time period $\tau_Q$ for the re-establishment of the equilibrium is especially dependent on the geometry of the display cells and on the physico-chemical properties of the materials bounding the cells and on those of the discharge gas.

For a given value of sustain-pulse voltage $V_S$, the development of the wide-gap discharge between the coplanar electrodes is very dependent on the matrix gap and on the capacitances of the dielectric layers covering the coplanar electrodes and, where applicable, the address electrode. It is preferable that the capacitance of the dielectric covering the coplanar electrodes $Y_{AS}$, $Y_S$ be high, in order to obtain a large stored charge at the end of the discharge (storage effect) This will, one the one hand, facilitate the initiation of the matrix discharge and, on the other hand, ensure a sufficiently energetic positive column. It is preferable that the capacitance of the dielectric covering the address electrode $X_A$ be, on the contrary, quite low, so as to allow the extension of the matrix discharge and its junction with the anode to occur as rapidly as possible.

With regard to the capacitive energy stored in the dielectric layer of the cathode $Y_{AS}$, the two discharges, matrix and coplanar, are now in competition. In order to favor the coplanar discharge over the matrix discharge which exhibits a lower luminous efficiency, it is preferable to operate under conditions designed to maximize the ratio of transferred charges $Q_C/Q_M$. One means of achieving a high value for this ratio is to adapt or adjust, in a manner known per se, the thickness of the dielectric layers, their electrical permittivity, or the electrode geometry.

As will be seen hereinafter, the trigger phase is decisive for the subsequent evolution of the discharge, as much in terms of stability as in terms of efficiency of this discharge. The initiation and extension of the discharges depends largely on the structure of the discharge cells or regions of the display. It has also been observed that achieving stable wide-gap discharges is very sensitive to the shape and to the synchronization of the sustain signals and the trigger signals.

The invention relates essentially to the duration $\tau_M$, the timing of the beginning and end of the trigger pulse, relative to the timing of the beginning and end of the plateau $V_S$ of the sustain pulse.

According to a first embodiment of the invention, a value of the sustain plateau voltage $V_S$ is chosen below the minimum coplanar sustain voltage $V_{S\text{-}min}$ such that a coplanar discharge is only possible when a trigger pulse is applied to the address electrode.

According to the invention, it is required to determine the duration $\tau_M$ of the trigger pulse. The trigger pulse should be of sufficiently long duration to allow breakdown in the matrix between the panels and the initiation of the coplanar discharge between the coplanar electrodes. It has been observed that the minimum duration for a gas mixture containing 4% Xe at a pressure of $0.6\times10^5$ Pa is 100 ns. Preferably, therefore, $\tau_M>100$ ns. Generally speaking and for other discharge gas composition and pressure conditions, the duration $\tau_M$ of the trigger pulse should be longer than the coplanar discharge initiation time $\tau_C$. $\tau_C$ corresponds to $T_C$-$T_M$, where $T_M$ is the moment of the beginning of the trigger pulse ($T_{M1}$ or $T_{M2}$ in FIG. 4A depending on whether the first or second discharge is being considered) and where $T_C$, which was already defined with reference to FIG. 5, is the moment at which the current flowing through the trigger electrode $I_{XA}$ becomes zero. The time $T_C$ therefore corresponds to the moment when the discharge light emission in the infrared connects the coplanar cathode to the coplanar anode. This moment can be observed with a camera.

The trigger pulse should end early enough to allow a sufficient regeneration of the positive charge on the region of dielectric layer covering the trigger electrode after the end of the trigger pulse but before the following sustain pulse. "Sufficient regeneration" means a level of stored positive charge that allows a complete discharge to be generated when the potential associated with this charge is added to the trigger pulse potential during this following sustain pulse. This stored charge is acquired by volume drainage of the charges, and it is therefore important that the volume density of these charges be sufficiently high. In order to achieve a sufficient density, it is observed experimentally that the trigger pulse should end no more than one microsecond after the beginning of this same pulse, especially for the conditions of gas composition and pressure described above.

According to the invention, it is also required to determine the position of the trigger pulse with respect to the sustain pulse using the delay time value $\tau_R$, previously defined as the interval of time between the beginning of a sustain pulse plateau and the beginning of a trigger pulse. The trigger pulses should be started at the beginning of the sustain pulse plateau at the earliest, in other words no earlier than the end of the rise time of this pulse. Therefore: $0\leqq\tau_R\leqq\tau_P$. The trigger pulses should be ended no later than the end of the sustain pulse plateau, in other words the beginning of the fall time of this pulse. Therefore: $\tau_M\leqq$, $\tau_P$ and $\tau_R\leqq\tau_P-\tau_M$; as already indicated, the trigger pulse should end early enough to allow a sufficient regeneration of the positive charge stored on the dielectric covering the trigger electrode after the trigger pulse has ended but before the end of the sustain pulse plateau. It has been experimentally established that the drainage time of the space charges necessary for this regeneration is approximately 1 μs, notably under the conditions of gas composition and pressure described above: thus, if $\tau_P\geqq1.2$ μs, in other words, in practice, for sustain periods $\tau_S\geqq2.4$ μs or for sustain frequencies below about 400 kHz (which is generally true in practice), this condition can then be expressed as $\tau_M\leqq\tau_P-1$ μs and $\tau_R\leqq\tau_P-1$ μs$-\tau_M$.

When the duration $\tau_P$ of the sustain plateau is less than 1.2 μs, in other words in the case of sustain frequencies above about 400 kHz, the presence of more numerous charges in the discharge volume reduces the breakdown voltages, such that the storage charge to be regenerated on the dielectric layers in order to generate a complete discharge during the following sustain pulse is less than the storage charge to be regenerated at a lower frequency, such as previously described, and this reduced storage charge does not change the ignition properties of the trigger discharge. In this high-frequency domain, the minimum time for regeneration of the stored charges can thus be reduced to below the value of 1 μs previously described, however, especially under the conditions of gas composition and pressure described above, the following should be respected:

- the duration $\tau_M$ of the trigger pulses should be less than or equal to 200 ns, while still being greater than 100 ns (see point 1.a above),
- the delay time $\tau_R$ should be close to zero ($\tau_R\cong0$ μs), in other words less than 100 ns.

The general timing conditions for the implementation of the trigger pulse can be summarized in the following form:

- if $\tau_P\geqq2$ μs, 100 ns$\leqq\tau_M\leqq1$ μs and $\tau_R\leqq\tau_P-1$ μs$-\tau_M$,
- if 1.2 μs$\leqq\tau_P\leqq2$ μs, 100 ns$\leqq\tau_M\leqq\tau_P-1$ μs and $\tau_R\leqq\tau_P-1$ μs $-\tau_M$,
- if $\tau_P<1.2$ μs, 100 ns$\leqq\tau_M\leqq200$ ns and $\tau_R\cong0$ μs.

Figure 10:
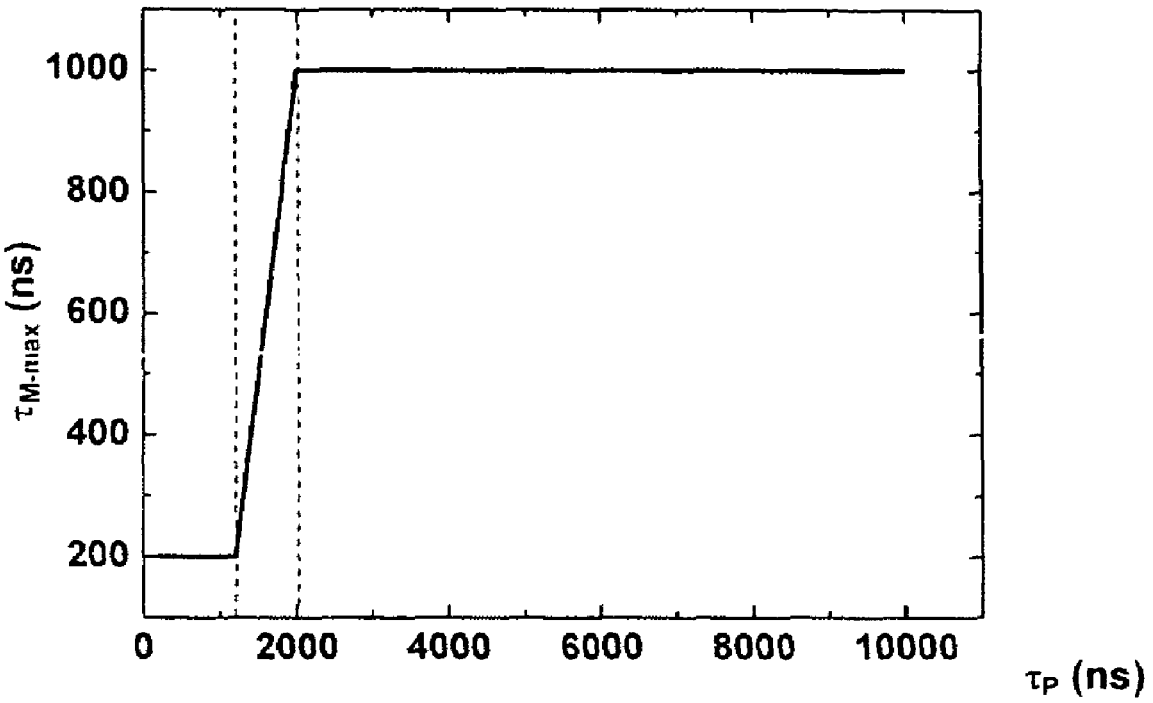
FIG. 10 shows the maximum duration $\tau_{M\text{-}max}$ of the trigger pulse as a function of the duration $\tau_P$ of the sustain pulse.

Such timing conditions allow both the intensity and luminous efficiency of the discharges to be significantly improved, while at the same time guaranteeing the stability of the discharges when driving the display. These conditions in regard to the peak value $\tau_{M\text{-}max}$ of $\tau_M$ are shown in FIG. 10. It can be seen that, whatever the frequency of the sustain pulses, the duration $\tau_M$ of the trigger pulses is less than 1 μs.

The duration $\tau_M$ of the trigger pulse can be greater than or equal to the total duration $\tau_T$ of the discharge, defined as the time interval between the moment $T_M$ when the trigger pulse begins and the moment $T_T$ when the coplanar discharge ends as previously defined.

Preferably, in order to optimize the emission intensity and the efficiency of the discharges, the duration $\tau_M$ of the trigger pulse will, on the contrary, be chosen such that the latter finishes before the moment $T_{I\text{-}max}$ when the discharge light emission reaches its peak, in other words $\tau_M < \tau_{I\text{-}max}$, where $\tau_{I\text{-}max}$ is defined as the interval of time between the moment $T_M$ when the trigger pulse begins and the previously defined moment $T_{I\text{-}max}$.

According to a second embodiment of the invention, a value of the sustain plateau voltage $V_S$ is chosen higher than or equal to the minimum coplanar sustain voltage $V_{S\text{-}min}$ such that a coplanar discharge would self trigger even in the absence of a trigger pulse on the address electrode. According to the invention, the trigger discharges will now be used, advantageously, to trigger the coplanar discharges prematurely. It is, of course, no longer possible to vary, in the same proportions as before, the delay time $\tau_R$ between the beginning of the sustain pulse plateau and the beginning of the trigger pulse. The optimum conditions as regards the pulse duration are identical to the first embodiment. In order to define the optimum moment for the beginning of the trigger pulse, the moment $T_C$ when the trigger electrode current $I_{XA}$ becomes zero will here be taken as a reference which amounts to defining the optimum values of the duration $\tau_C$ of the initiation of the coplanar discharge, where $\tau_C$ (defined above) corresponds to $T_C$-$T_M$.

According to the invention, the beginning of the pulse is chosen such that the pulse starts about 100 ns before the moment of coplanar extension $T_C$ of the discharge as previously defined (moment when $I_{XA}$ becomes zero). Generally speaking, the duration $\tau_C$ that controls the start time of the trigger pulse will be chosen such that 50 ns$\leqq\tau_C\leqq$150 ns. By defining the beginning of the trigger pulse in this manner, it is ensured that it is really the trigger discharge that causes the sustain coplanar discharge, whereas the latter could have been triggered spontaneously without the additional trigger pulse. When the coplanar discharge is triggered prematurely in this manner by a trigger pulse as described above, the luminous efficiency and the stability of the discharges are improved.

The general timing conditions of the implementation of the trigger pulse for the case $V_S \geqq V_{S\text{-}min}$ can be summarized in the following form:

50 ns$\leqq\tau_C\leqq$150 ns, and, as in the first embodiment:

if $\tau_P \geqq 2$ μs, 100 ns$\leqq\tau_M\leqq$1 μs, if 1.2 μs$\leqq\tau_P\leqq$2 μs, 100 ns$\leqq$, $\tau_M\leqq\tau_P$−1 μs, if $\tau_P$<1.2 μs, 100 ns$\leqq\tau_M\leqq$200 ns.

In both the first and second embodiments, the general conditions according to the invention relating to the duration and positioning of the trigger pulses with respect to the sustain pulses offer, in particular, the following advantages: better control of the triggering and evolution of the discharges allowing stable discharges to be obtained in the display; and better optimization of the luminous efficiency, either by increasing the luminance or by decreasing the current, or by increasing the luminance and decreasing the current.

Generally speaking, the pulses applied to the address electrodes allow: a redistribution of the field in the cells relative to the field in the absence of trigger pulses, thus favouring, after the initiation phase, the development of coplanar discharges under a weaker field resulting in a reduction in the discharge current and an increase in the excitation of the xenon; and a reduction in the sustain potential applied to the coplanar electrodes.

Thus, the discharge efficiency can be increased, especially if the currents $I_{XA}$ on the address electrodes remain at a sufficiently low level.

The remainder of the description of the invention presents results obtained using a plasma display such as that described above which is filled with a 4% Xe/Ne mixture at a pressure of $0.6\times10^5$ Pa and whose coplanar electrodes are supplied by a sustain generator delivering alternating sustain pulses at a frequency of 150 kHz. The discharge optical and electrical characteristics will now be analysed as a function of the amplitude, the width and the positioning of the trigger pulses relative to the sustain pulses. Here, the sustain plateau voltage $V_S$ is chosen to be lower than the minimum sustain voltage $V_{S\text{-}min}$ that would allow coplanar discharges to be obtained without a trigger pulse.

Taking therefore $\tau_S/2$=3333 ns and $\tau_P$ greater than 2 μs, the general conditions set out above therefore stipulate that:

100 ns$\leqq\tau$M$\leqq$1 μs and $\tau_R\leqq\tau_P$−1 μs−$\tau_M$.

Taking $\tau_M$=250 ns (see FIG. 4A), $\tau_R$ should therefore be such that $\tau_R\leqq$2 μs.

Figure 6A:
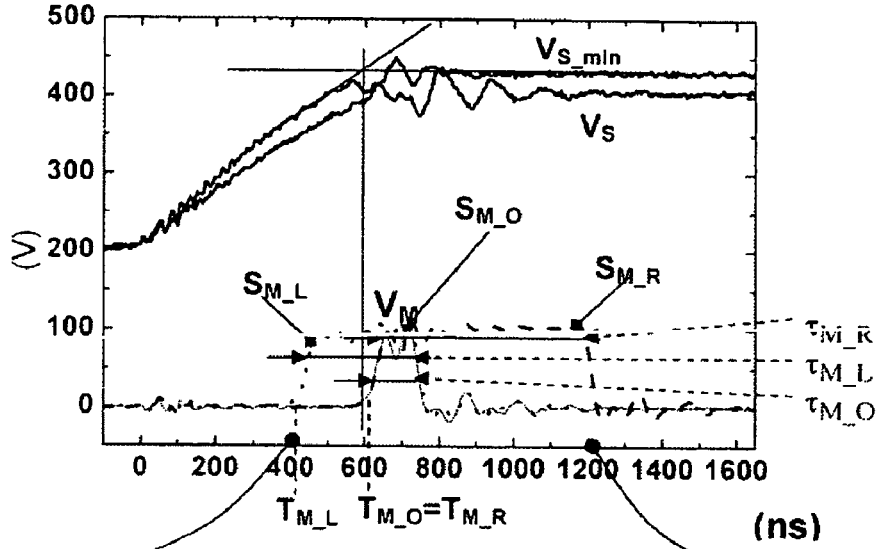
FIG. 6A shows three types of trigger pulses in the same presentation mode as FIG. 4A.

FIG. 6A shows the first half of the sustain pulse signal of FIG. 4A with three variants of trigger signal:

$S_{M_O}$ corresponds to what is called the optimized signal, of duration $\tau_{M_O}$, triggered at time $T_{M_O}$ during the sustain pulse plateau $V_S$;

$S_{M_L}$ corresponds to a signal (denoted "left"), of duration $\tau_{M_L}$, triggered at time $T_{M_L}$ during the voltage rising edge of the sustain pulse;

$S_{M_R}$ corresponds to a signal (denoted "right"), of duration $\tau_{M_R}$ much longer than $\tau_{M_O}$, triggered at time $T_{M_R}$=$T_{M_O}$ during the sustain pulse plateau $V_S$.

All these signals have the same voltage amplitude $V_M$.

Figure 6B:
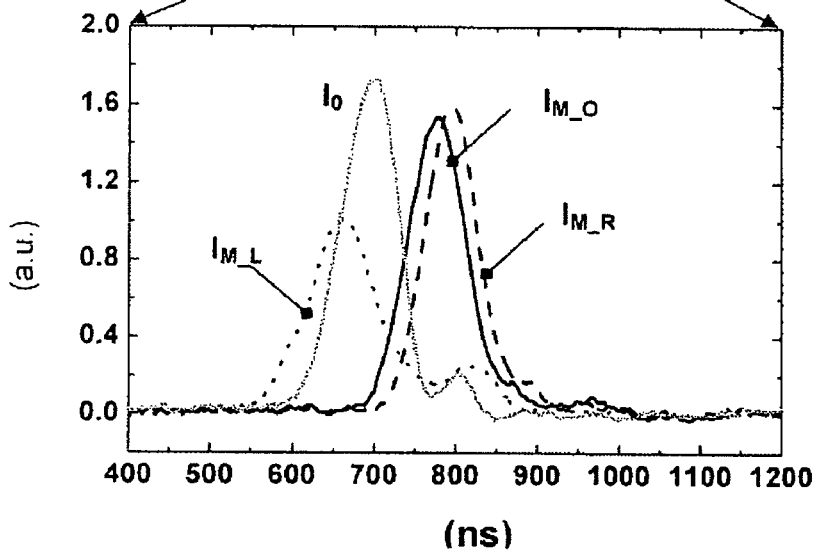
FIGS. 6B and 6C show the discharge current and light intensity obtained for each type of trigger pulse, respectively.
Figure 6C:
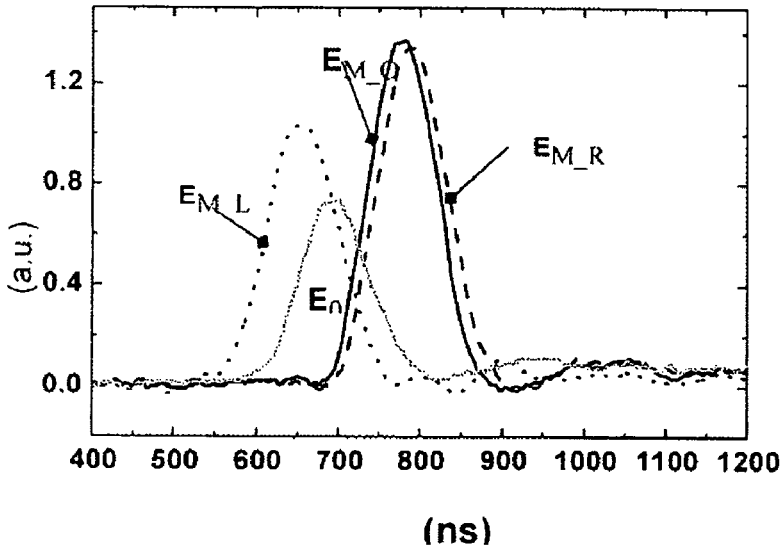

FIG. 6B shows the corresponding current intensities $I_{M_O}$, $I_{M_L}$ and $I_{M_R}$ on the electrode $Y_S$ of the discharges obtained for these three variants of trigger signals $S_{M_O}$, $S_{M_L}$ and $S_{M_R}$, respectively. FIG. 6C shows the corresponding xenon light intensities at a wavelength 854 nm $E_{M_O}$, $E_{M_L}$ and $E_{M_R}$ obtained for these three variants of trigger signals $S_{M_O}$, $S_{M_L}$ and $S_{M_R}$, respectively; the xenon intensity at 854 nm is generally considered to be representative of the luminous energy intensity of the discharge.

For comparison, the current intensity $I_0$ and the light intensity $E_0$ have been added to FIGS. 6B and 6C; these values represent what would be obtained in conventional cases without trigger pulse but, necessarily, where a sustain pulse is high enough, here namely $V_{S\text{-}min}$ as previously defined, to obtain discharges without matrix triggering.

It can be seen that the optimized pulse $S_{M_O}$ has a position and width that lead to a peak xenon emission for a lower discharge current than that $I_0$ obtained in the absence of a trigger pulse with sustain pulses of amplitude $V_{S\text{-}min}$. In this optimum case, the trigger pulse starts at the end of the sustain pulse rising edge and finishes after the initiation of the coplanar discharge (T>$T_C$), even before the peak current has been reached (compare $S_{M_O}$ in FIG. 6A and $I_{M_O}$ in FIG. 6B). This pulse leads to an electric field distribution in the discharge region that is favourable to the triggering of the matrix discharge and to the development of the coplanar discharge under a weaker field than in the absence of the trigger pulse with sustain pulses of amplitude $V_{S\text{-}min}$, which results in a more intense light emission and, consequently, in a higher discharge luminance and efficiency. The discharge is also more stable since the regeneration time of the stored charges at the end of the trigger pulse is much longer than 1 μs.

In applying the "left" signal $S_{M_L}$, the trigger pulse is started during the rising edge of the sustain pulse, and this pulse is ended at the same time as the optimized signal $S_{M_O}$. It can now be seen that the coplanar discharge no longer spreads out or is very unstable. Indeed, at the moment of the matrix discharge, the potential difference between the two coplanar electrodes is insufficient to initiate the coplanar discharge correctly since the sustain plateau $V_S$ has not yet been reached. This makes the discharges unstable and results in a defective operation of the display. In this case of the "left" signal $S_{M_L}$, the coplanar discharge is disadvantaged with respect to the matrix discharge which leads to a significant reduction in the current $I_{M_L}$ (FIG. 6B) and the xenon emission $E_{M_L}$ (FIG. 6C) relative to the previous case of the optimized pulse. For a stable discharge operation, the control pulse should therefore start, at the earliest, after the end of the rising edge of the sustain pulse as set out in the general conditions above.

In applying the "right" signal $S_{M_{13}D}$, the trigger pulse is started at the same moment as for the optimized signal $S_{M_O}$, but this pulse is ended after the end of the discharge (so, after time $T_T$). The duration $\tau_{M_R}$ of this pulse is therefore longer than $\tau_{M_O}$ but shorter than one microsecond as is set out above in the general conditions. It can be seen from FIGS. 6B and 6C that, under these conditions, the discharge characteristics obtained are satisfactory with very little difference from those of the optimized case. Nevertheless, a slight decrease in efficiency is noted that may be as much as 10% when moving away in this manner from the optimum point of operation.

According to one variant, the trigger pulses can be obtained by keeping the address electrode potential constant but by superimposing onto the sustain pulses complementary pulses of opposite polarity for each electrode of the sustain pairs, as shown in F*igure* 7.

As has just been seen, the stability of wide-gap discharges is very sensitive to the form and to the synchronization of the trigger signals.

This stability also depends on the sustain signals: for example, the conventional sustain signals used in narrow-gap discharges cannot be applied in the case of wide-gap discharges because of the creation of self-erasing discharges. These self-erasing discharges, which lead to an inhibition of the development of the coplanar discharge (in other words, the failure of the coplanar discharge to spread out), can appear: during the sustain signal zero level plateaux, between two pulses, in the application of multilevel signals; and when the triggering of the discharge takes place simultaneously between the electrodes $Y_{AS}$ and $X_A$ on the one hand, and $Y_s$ and $X_A$ on the other. This can be the case when the coplanar electrodes have a large surface area, in other words a large capacitance on the front face. In this case, in addition to the initiation between $Y_{AS}$ and $X_A$, too much stored charge could lead to an initiation between $Y_S$ and $X_A$, with the electrode $X_A$ as cathode.

In order to avoid the production of self-erasing discharges and/or to reinforce the coplanar discharge, according to the invention, it is preferable to avoid intermediate plateau levels, especially at zero volts, in between the extreme plateaux of the sustain pulses; FIG. 8A describes a conventional example of sustain signals without any intermediate plateau between the extreme plateaux. The corresponding trigger signals are shown in FIG. 8B.

Figure 9A:
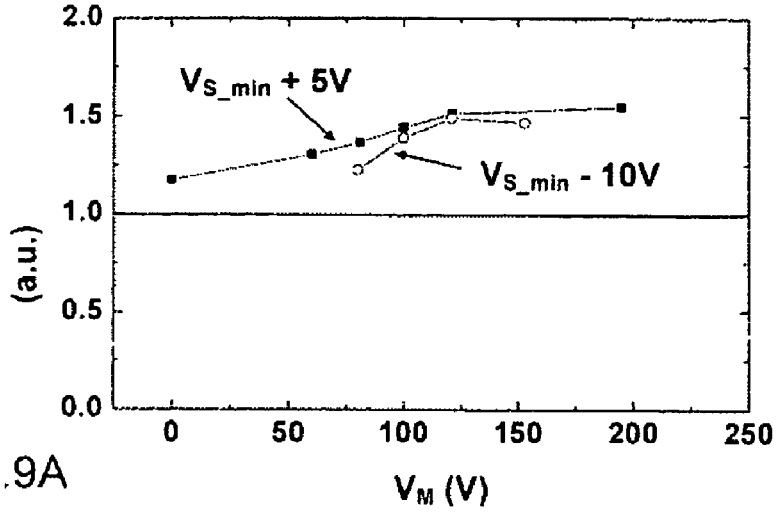
FIGS. 9A, 9B and 9C, respectively, show the luminance, current and luminous efficiency of discharges as a function of the trigger pulse amplitude $V_M$ for two potential values of the sustain pulses, one 10 V below and the other 5 V above the spontaneous sustain threshold value $V_{S\text{-}min}$ (the luminances, currents and efficiencies are shown normalised with respect to the luminance, current and efficiency obtained in the absence of trigger pulses with sustain pulses at $V_S = V_{S\text{-}min}$)
Figure 9B:
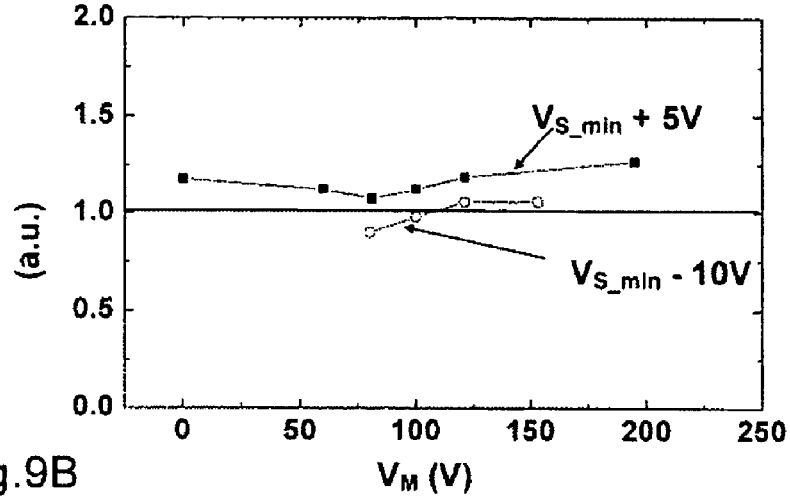
Figure 9C:
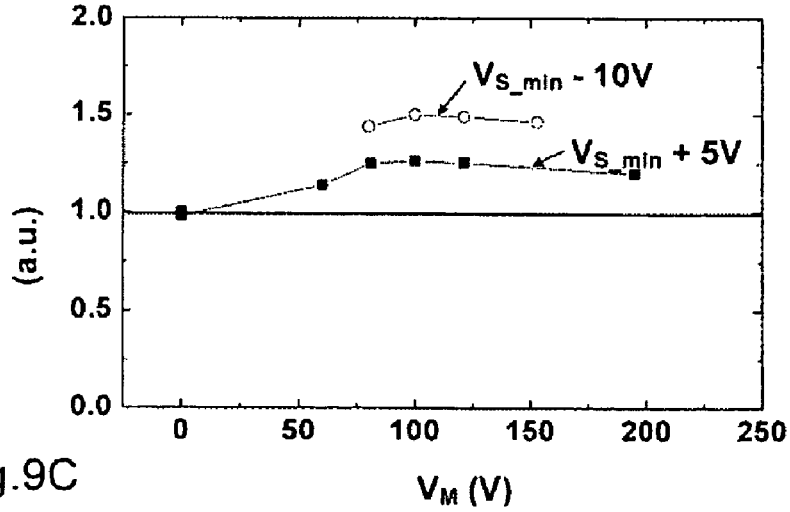

The luminance, the discharge current and the efficiency of the discharges are shown in FIGS. 9A, 9B and 9C as a function of the amplitude $V_M$ of trigger pulses of optimized duration $\tau_M$ for two values of the potential $V_S$ applied to the coplanar electrodes:

$V_S = V_{S_min} + 5V$ $V_S = V_{S_min} - 10V$.

The results are presented in a normalized from with respect to the values obtained at $V_S \cong V_{S_min}$ and $V_M = 0$.

It is observed experimentally that by working at $V_S < V_{S_min}$, the luminous efficiency can be increased in a more significant way (FIG. 9C). For example, under the operating conditions presented above, the luminous efficiency of 2 lm/W at $V_S = 225$ V has been increased to 3 lm/W for $V_S = 200$ V and a matrix pulse $V_M = 100$ V.

The luminance (FIG. 9A) and the efficiency (FIG. 9C) increase as the trigger pulse amplitude increases up to a certain value that depends on $V_S$: the decrease in coplanar potential $V_S$ requires higher-amplitude trigger pulses.

For higher $V_M$, the efficiency falls back: the matrix discharge of low efficiency starts to dominate the coplanar discharge.

The invention of claimed is:

1. Method for driving a plasma display for displaying images, comprising: sustain electrode arrays and at least one trigger electrode array, discharge regions which are each crossed by a pair of sustain electrodes ($Y_s$, $Y_{AS}$) and at least one trigger electrode ($X_A$), the said method comprising a succession of image frames or subframes which each comprise a discharge region sustain phase which itself comprises the application of approximately constant sustain voltage pulses $V_S$ between the electrodes of each pair serving these regions, and the application of a trigger voltage pulse $V_M$ between the trigger electrode ($X_A$) and one and/or the other of the electrodes of each pair serving these regions, the sustain voltage $V_S$ being greater than or equal to the value $V_{S\text{-}min}$ from and beyond which sustain discharges can be obtained in the display without trigger pulses during the sustain phases and the voltage $V_M$ being designed to trigger a plasma discharge between the electrodes of the said pair, characterized in that the duration $\tau_M$ of each trigger pulse is less than 1 μs and in that if the time interval between the beginning of a trigger pulse and the moment when the discharge current in the trigger electrode ($X_A$) becomes zero is denoted $\tau_C$, then: 50 ns $\leqq \tau_C \leqq$ 150 ns.

2. Method for driving according to claim 1, wherein the duration of the voltage plateau $V_S$ of the sustain pulses is denoted $\tau_P$: if $\tau_P \geqq 2$ μs, 100 ns $\leqq \tau_M \leqq 1$ μs; if 1.2 μs $\leqq \tau_P \leqq 2$ μs, 100 ns $\leqq \tau_M \leqq \tau_P - 1$ μs; or if $\tau_P < 1.2$ μs, 100 ns $\leqq \tau_M \leqq 200$ ns.

3. Method for driving according to claim 1, wherein there is no voltage plateau between two consecutive sustain pulses during a sustain phase.

4. Method for driving a plasma display for displaying images, comprising: sustain electrode arrays and at least one trigger electrode array, discharge regions which are each crossed by a pair of sustain electrodes ($Y_S$, $Y_{AS}$) and at least one trigger electrode ($X_A$), the said method comprising a succession of image frames or subframes which each comprise a discharge region sustain phase which itself comprises the application of approximately constant sustain voltage pulses $V_S$ between the electrodes of each pair serving these regions, and the application of a trigger voltage pulse $V_M$ between the trigger electrode ($X_A$) and one and/or the other of the electrodes of each pair serving these regions, the sustain voltage $V_S$ being lower than the value $V_{S\text{-}min}$ from and beyond which sustain discharges can be obtained in the display without trigger pulses during the sustain phases and the voltage $V_M$ being designed to trigger a plasma discharge between the electrodes of the said pair, characterized in that each trigger pulse is applied during a sustain pulse and in that the duration $\tau_M$ of each trigger pulse is less than 1 μs.

5. Method for driving according to claim 4, wherein the duration of the sustain pulses is denoted $\tau_P$ and the time interval between the beginning of the plateau of a sustain pulse and the beginning of a corresponding trigger pulse is denoted $\tau_R$: if $\tau_P \geqq 2$ μs, 100 ns$\leqq\tau_M\leqq$1 μs and $\tau_R\leqq\tau_P-1$ μs$-\tau_M$; if 1.2 μs$\leqq\tau_P\leqq$2 μs, 100 ns$\leqq\tau_M\leqq\tau_P-1$ μs and $\tau_R\leqq\tau_P-1$ μs$-\tau_M$; or if $\tau_P<1.2$ μs, 100 ns$\leqq\tau_M\leqq$200 ns and $\tau_R<100$ ns.

6. Method according to claim 5, wherein if the time interval between the moment $T_M$ of the beginning of a trigger pulse and the moment $T_{I\text{-}max}$ of the peak light emission of the sustain discharge triggered by this trigger pulse is denoted $\tau_{I\text{-}max}$, then $\tau_M<\tau_{I\text{-}max}$.

7. Method for driving according to claim 4, wherein there is no voltage plateau between two consecutive sustain pulses during a sustain phase.

8. Device for displaying images, comprising:

a plasma display comprising sustain electrode arrays and at least one trigger electrode array;

discharge regions which are each crossed by a pair of sustain electrodes ($Y_S$, $Y_{AS}$) and at least one trigger electrode ($X_A$); and means for implementing the driving method according to claim 1.

9. Device for displaying images, comprising:

a plasma display comprising sustain electrode arrays and at least one trigger electrode array, discharge regions which are each crossed by a pair of sustain electrodes ($Y_S$, $Y_{AS}$) and at least one trigger electrode ($X_A$); and means for implementing the driving method according to claim 1, wherein the distance separating the sustain electrodes ($Y_S$, $Y_{AS}$) of a same pair within each region is greater than the distance separating the trigger electrode ($X_A$) from one and/or the other electrodes of this pair within this same region.

10. Device for displaying images comprising:

a plasma display comprising sustain electrode arrays and at least one trigger electrode array, discharge regions which are each crossed by a pair of sustain electrodes ($Y_S$, $Y_{AS}$) and at least one trigger electrode ($X_A$); and means for implementing the driving method according to claim 1, wherein the said discharge regions are partitioned by barrier ribs disposed such that any two adjacent trigger electrodes from the said trigger array are separated by a barrier rib.

* * * * *